United States Patent [19]

Kuo

[11] Patent Number: 4,910,365

[45] Date of Patent: Mar. 20, 1990

[54] SECURABLE ROCKER SWITCH USED FOR PERSONAL PROTECTION DEVICES

[76] Inventor: Stanley Kuo, P.O. Box 44-256, Taipei, Taiwan

[21] Appl. No.: 345,775

[22] Filed: May 1, 1989

[51] Int. Cl.[4] ..... H01H 3/20

[52] U.S. Cl. ..... 200/43.16; 200/321

[58] Field of Search ..... 200/43.16, 43.17, 43.18, 200/321, 322, 318.1

[56] References Cited

U.S. PATENT DOCUMENTS

| | | | |
|---|---|---|---|
| 4,002,874 | 1/1977 | Brown | 200/321 |
| 4,044,215 | 8/1977 | Leibinger et al. | 200/321 X |
| 4,187,420 | 2/1980 | Piber | 200/43.16 |

FOREIGN PATENT DOCUMENTS

| | | | |
|---|---|---|---|
| 1947014 | 3/1971 | Fed. Rep. of Germany | 200/321 |

*Primary Examiner*—Renee S. Luebke

[57] ABSTRACT

A rocker switch is provided with a safety pin which can be slidably pushed forwardly to lock the rocker switch to prevent any unexpected or accidental depression of the switch to prevent any unwanted alarm or injury caused by a personal protection equipment provided with such a rocker switch. The safety pin can also be slidably retracted backwardly to unlock the rocker switch for actuating the personal protection equipment for security purpose.

1 Claim, 2 Drawing Sheets

SECURABLE ROCKER SWITCH USED FOR PERSONAL PROTECTION DEVICES

BACKGROUND OF THE INVENTION

A conventional rocker switch may be provided in a personal protection equipment such as a burglar alarm or an electric-shock producer so that upon a depression of the rocker switch, the alarm may be actuated to warn a possible burglar or the electric-shock producer be actuated to repel a possible rapist.

However, the rocker switch as provided in such conventional protection equipment may be accidentally depressed to spread an unexpected alarm warning or even to injure its owner who may be striken by an electric shock of high voltage.

The present inventor has found the drawbacks of conventional personal protection equipment and invented the present rocker switch having securable locking means.

SUMMARY OF THE INVENTION

The object of the present invention is to provide a rocker switch having a lock means which can be operated to forward a latching pin of the lock means to be under a button portion of the switch to retard the depression of the rocker switch so as to prevent an unexpected turn-on of the switch, especially formed in a personal protection device.

DETAILED DESCRIPTION

Figure 1:
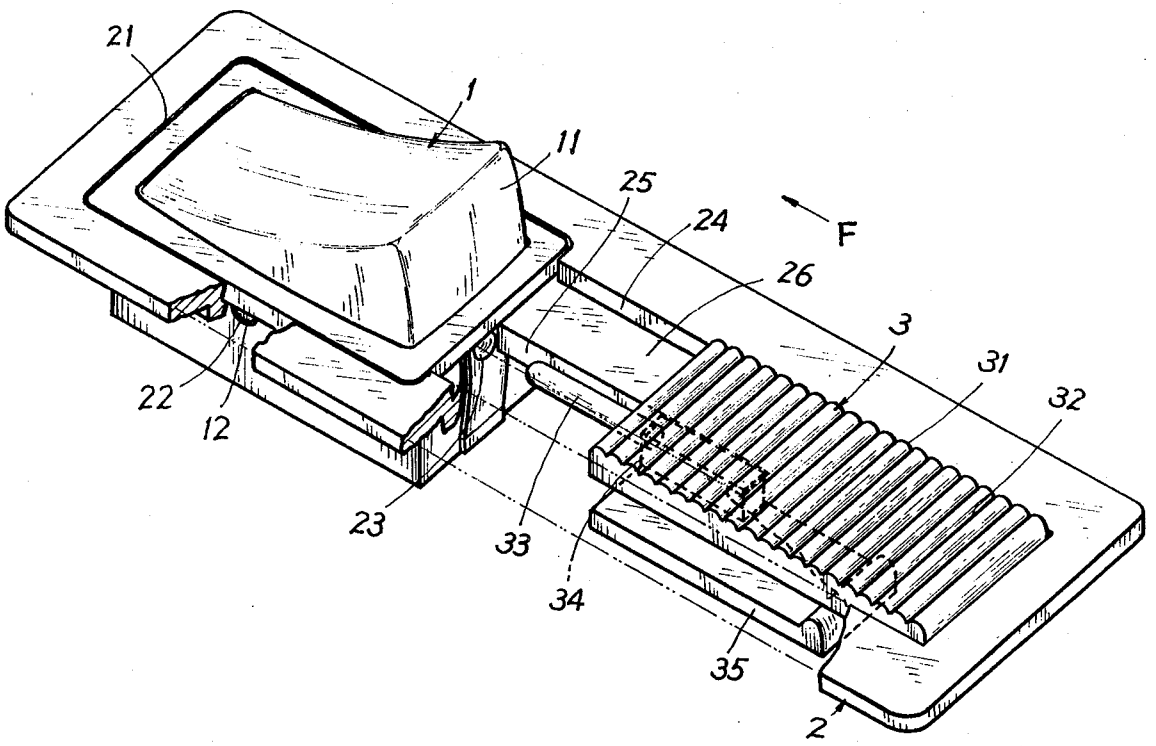
FIG. 1 is an illustration of the present invention.
Figure 2:
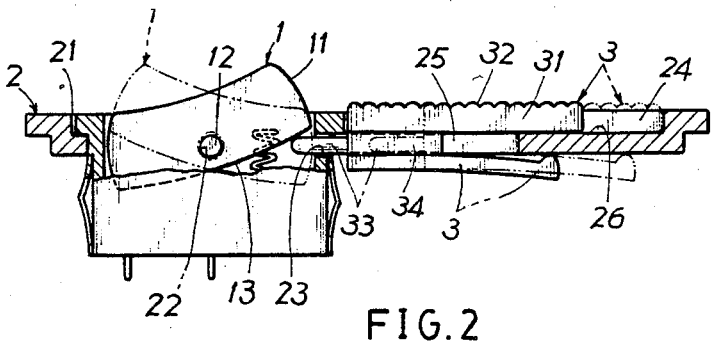
FIG. 2 is a side-view drawing of the present invention.
Figure 3:
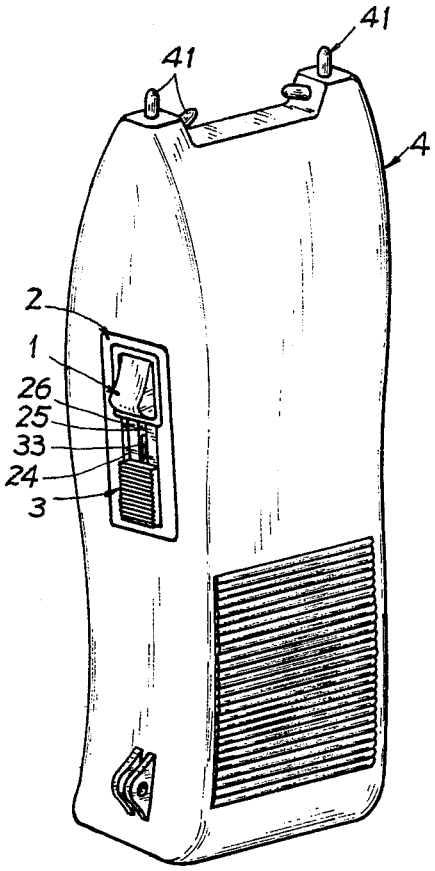
FIG. 3 is an illustration showing an application of the present invention in a personal protection device.

As shown in FIGS. 1–3, the present invention comprises: a rocker switch 1, a switch housing 2, and a lock means 3.

The rocker switch 1 is a seesaw having a button portion 11 resiliently biased outwardly from the switch housing 2 to keep the switch normally open, and a pair of pivots 12 formed on a central portion of the switch 1 to be pivotally mounted in a socket 21 of the switch housing 2.

The switch housing 2 includes: a socket 21 for pivotally mounting the switch 1 therein, a pair of pivot holes 22 formed in the socket 21 engageable with the pivots 12, a pin hole 23 formed in an end portion of the housing 2, a slide groove 24 longitudinally recessed in an end portion of the housing 2 adjacent to the pin hole 23, a longitudinal slit 25 formed in a central portion of the slide groove 24 generally aligned with the pin hole 23, and a sliding plate 26 serving as a base surface of the slide groove 24.

The lock means 3 includes: a slide 31 slidably engageable with the slide groove 24 having a corrugated surface 32 formed on its outer surface for frictionally forwarding or backing the slide 31, a latching pin 33 protruding from the slide 31 towards the button portion 11 to operatively insert through the pin hole 23 of the housing 2, a connector 34 protruding inwardly from the slide 31 perpendicular to the slide 31 and slidably engageable with the central longitudinal slit 25, and an inner plate 35 secured to the connector 34 generally parallel to the slide 31 and slidably clamping the plate 26 for slidably retaining the slide 31 in the slide groove 24.

The rocker switch 1 with the lock means 3 formed in the switch housing 2 can be installed in any personal protection device such as an electric-shock producer 4 having electrodes 41 capable of producing electric shock of high voltage for repelling an intruder, a possible rapist or a burglar as shown in FIG. 3.

The rocker switch 1 of the present invention can also be applied to any other electric switch for preventing an unexpected turn-on of a power source, especially a dangerous machine, equipment or instrument.

For ensuring a locking state of a rocker switch of the present invention, the slide 31 of the lock means 3 can be pushed in direction F as shown in FIG. 1 to poke the latching pin 33 towards a back portion 13 of the button portion 11 of the rocker switch 1 to retard a depression of the button portion 11 to ensure the locking of the rocker switch 1 for preventing any unexpected actuation of personal protection equipment installed with the rocker switch 1.

For operating the personal protection device 4, the slide 31 can be retracted to unlock the button portion 11 of the rocker switch 1 which can then be operated as shown in dotted line of FIG. 2.

In carrying a conventional burglar warning alarm or portable personal protection equipment such as an electric-shock producer, people may worry about an unexpected depression of a rocker switch of the alarm or the personal protection device, thereby easily neglecting the carry of such conventional equipment.

After the disclosure of this invention, the rocker switch 1 of a personal protection device can be safely locked to prevent any false operation or accidental injury to its owner so that the people will be pleased to carry it for security purposes.

I claim

1. A rocker switch means comprising:

a rocker switch formed as a seesaw pivotally secured in a socket of a switch housing, having a button portion resiliently biased outwardly from the switch housing to keep the rocker switch normally open; and a lock means formed in the switch housing having a latching pin protruding from the lock means towards a back portion of the button portion of said rocker switch for retarding an unexpected depression of said rocker switch, the improvement which comprises:

said lock means including a slide slidably engageable in a slide groove longitudinally formed in the switch housing, the latching pin protruding towards the button portion of said rocker switch from the slide generally aligned with a pin hole formed in an end portion of the socket so that said slide is pushed to poke said latching pin through said pin hole of said switch housing for retarding said button portion of said rocker switch;

said slide of said lock means having a connector perpendicular to said slide protruding inwardly from said slide to be slidably engageable with a longitudinal slit formed in a central portion of the slide groove, and an inner plate secured to the connector generally parallel to the slide, said slide and said inner plate slidably retained on a sliding plate, said sliding plate serving as a base of said slide groove for movably engaging said slide in said slide groove.

* * * * *